United States Patent [19]

Chernock

[11] 3,963,412

[45] June 15, 1976

[54] UNITARY SPARK AND THUMB WHEEL

[76] Inventor: Stephen Peter Chernock, Flax Mill Lane, Milford, Conn. 06460

[22] Filed: Dec. 23, 1974

[21] Appl. No.: 535,274

[52] U.S. Cl. ..... 431/273

[51] Int. Cl.[2] ..... F23Q 1/02

[58] Field of Search ..... 431/273, 274, 276, 277, 431/151, 152

[56] References Cited

UNITED STATES PATENTS

| | | | |
|---|---|---|---|
| 2,779,179 | 1/1957 | Smith | 431/276 |
| 2,807,947 | 10/1957 | Rehwick | 431/276 |
| 3,439,994 | 4/1969 | Cassan | 431/276 |

FOREIGN PATENTS OR APPLICATIONS

| | | | |
|---|---|---|---|
| 557,649 | 5/1923 | France | 431/273 |
| 1,072,863 | 3/1954 | France | 431/273 |
| 892,642 | 1/1944 | France | 431/273 |

*Primary Examiner*—Carroll B. Dority, Jr.
*Attorney, Agent, or Firm*—Mattern, Ware, Davis & Stoltz

[57] ABSTRACT

By providing a spark wheel with its side, thumb, rotation-inducing discs forming part of a unitary, one-piece member, a unique and extremely useful spark and thumb wheel unit is achieved. Furthermore, this unique construction incorporates mounting pins having varying diameters in order to facilitate and provide for mechanical assembly of the spark and thumb wheel unit in position.

5 Claims, 4 Drawing Figures

FIG. 1
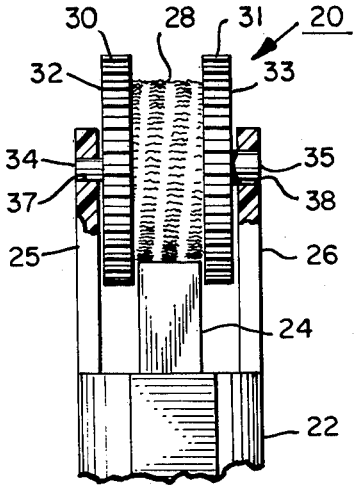
FIG. 3
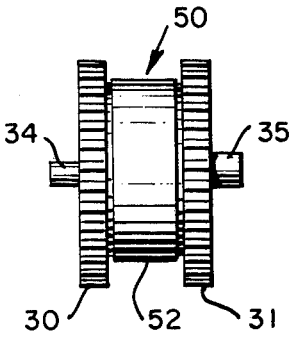
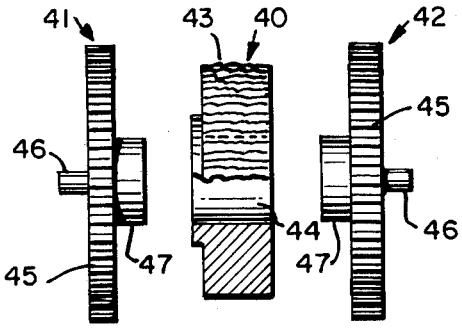
PRIOR ART
FIG. 2
FIG. 4
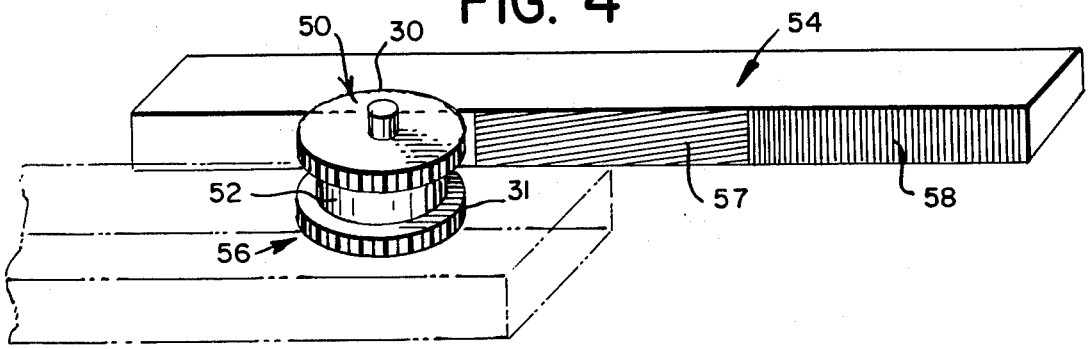

UNITARY SPARK AND THUMB WHEEL

BACKGROUND OF THE INVENTION

This invention relates to spark wheels and thumb control means for rotation of said spark wheels for use in cigarette lighters and the like, and more particularly to a unitary, one-piece spark and thumb wheel construction and a method for manufacturing the same.

In order to properly function, a spark wheel must incorporate an abrasive surface which, when rotated against a flint or similar pyrophoric material, will produce a spark to ignite a fuel-fed wick or jet of flammable gas. As is well-known in the art, before the abrasive surface can be formed, substantially parallel grooves must be formed in the cylindrical surface of the spark wheel body at an acute angle to the sides of the wheel in order to provide the proper offset spacing for the cutting edges of the spark wheel.

The two well-known prior art methods for producing the desired abrasive surface for the spark wheel are chiseling and broaching. The most commonly used prior art process is the chiseling process, in which the grooved spark wheel is rotated while a chiseling tool or blade reciprocatingly cuts into the peripheral surface of the spark wheel as the spark wheel is rotated about its central axis. The chiseling process forms a plurality of substantially linearly arranged inclined teeth in the surface of the spark wheel. This, in combination with the grooves which have been previously cut into the spark wheel surface, produces the required abrasive surface for the spark wheel. However, in order to provide sufficient support for holding the spark wheel and rotating the spark wheel during the chiseling process, a hole is formed completely through the center of the spark wheel in order to provide the required holding and rotating surface.

The second known process for producing spark wheels is disclosed in U.S. Pat. No. 2,455,348. As shown therein, the grooved cylindrical wheel is pushed through a broaching die to produce the desired abrasive surface for the spark wheel. Although a central hole or cavity is not required in order to achieve the broaching action, the produced spark wheel can only have a single diameter, namely the diameter of the desired spark wheel. As a result, a central cavity or hole is formed in the spark wheel in order to provide a surface for mounting the spark wheel in a lighter and for cooperatively mounting the necessary thumb rotation-inducing members.

Generally, once the spark wheel has been manufactured with its abrasive peripheral surface, two substantially identical discs, incorporating a spark wheel mounting shelf extending therefrom, are secured on either side of the spark wheel. The mounting shelves are constructed so as to be press-fitted into the central cavity or hole of the spark wheel, thereby achieving secure frictional engagement between the disc and the spark wheel.

Furthermore, the discs incorporate mounting pins extending from the opposite side of the spark wheel holding shelf which allow the spark wheel-disc assembly to be mounted in a lighter. Also, the discs incorporate an outer peripheral surface which is scored or ratchet-like in order to provide a gripping surface which allows the thumb of the user to rotate the discs in order to cause the spark wheel to rotate against the flint causing a spark which ignites the desired flame.

Many difficulties have been encountered in the prior art with the combination spark wheel and thumb wheel assemblies. One major difficulty repeatedly encountered is the inability of the mounting shelf of the thumb wheel to remain firmly frictionally engaged with the walls of the central cavity of the spark wheel. As a result, when the user of the lighter rotates the thumb wheel, the frictional force necessary to overcome the resistance of the spark wheel to rotate against the flint and cause the spark is greater than the frictional engagement between the spark wheel cavity and the thumb wheel mounting shelves. As a result, the thumb wheels rotate but the spark wheel does not. Obviously, this results in a cigarette lighter which is completely unfunctional.

Another major difficulty encountered with the prior art assemblies is the plurality of separate parts that are required and the cost of assembling these various parts into an operable unit mounted in a lighter system. One of the primarily important assembly steps is the positioning of the spark wheel with the proper orientation to provide a spark when rotated towards the flammable gas. Since identically sized thumb wheels are mounted on both sides of the spark wheel, the assembler of the lighter must visually check each spark wheel and thumb wheel assembly to be certain that the orientation of the spark wheel abrasive surface is proper before mounting this assembly in the lighter. This results in an extremely costly assembly operation. Furthermore, the plurality of separate parts and the various operations which must be performed on these parts requires repeated handling during the production process, thereby causing extremely high production costs.

OBJECTS OF THE INVENTION

Therefore, it is a principal object of this invention to provide a one-piece spark and thumb wheel unit which is manufactured from the single piece of stock material.

Another object of this invention is to provide a one-piece spark and thumb wheel unit of the above character in a manner that reduces the handling time and substantially increases automation.

Another object of this invention is to provide a one-piece spark and thumb wheel unit of the above character having the ability to be automatically assembled into a lighter.

A further object of this invention is to provide a one-piece spark and thumb wheel unit of the above character which is capable of being manufactured rapidly and efficiently, thereby providing a relatively inexpensive unit.

Another object of this invention is to provide a one-piece spark and thumb wheel unit of the above character which is capable of being automatically assembled into a cigarette lighter in a fast and efficient manner.

Another object of this invention is to provide a one-piece spark and thumb wheel unit of the above character which completely eliminates rotational failure of the spark wheel across the flint.

Other and more specific objects will in part be obvious and will in part appear hereinafter.

SUMMARY OF THE INVENTION

The one-piece spark and thumb wheel unit of this invention comprises an over-all cylindrical shape incorporating a central portion having a smaller diameter than the cylindrical body. This central portion comprises an abrasive peripheral surface which forms the spark surface required to produce the necessary spark when frictionally rubbed against a flint. This central spark wheel portion is flanked on both sides by the remainder of the cylindrical body which comprises a diameter slightly greater than the central portion. The outer peripheral surface of these end portions incorporates a grooved or ratchet-like outer peripheral surface. The outer peripheral surface of the end portions provides a surface easily grippable by the thumb of the user for causing rotation of the spark wheel portion of the unit.

The sides of the cylindrical body are substantially flat, but do incorporate two mounting posts extending along the central axis of the cylindrical body. In the preferred embodiment these mounting posts comprise varying diameters in order to allow easy mechanical orientation of the spark and thumb wheel unit in the proper direction.

By employing the one-piece spark and thumb wheel unit of this invention, the various steps required to assemble the prior art construction is completely eliminated with this one unit comprising all of the necessary elements ready for mounting in a lighter. Furthermore, by incorporating the optional dual diameter mounting pins on the outer surface of the spark and thumb wheel unit of this invention, the mounting of the unit in the lighter can be accomplished automatically while assuring that the abrasive peripheral spark wheel surface is mounted in the desired orientation. This completely eliminates the costly manual handling and assembly required in prior art assemblies. As a result, the one-piece spark and thumb wheel unit of this invention provides innumerable advantages heretofore unobtainable using prior art techniques and knowledge, thus producing a substantial advance in the art, resulting in a substantial reduction in the production costs inherent in the assembly of cigarette lighters.

The one-piece spark and thumb wheel unit of this invention is manufactured in two basic steps. The first step is preferably accomplished on a automatic screw machine with the spark and thumb wheel unit incorporating the mounting pins being blanked out in a single manufacturing operation. If desired, the outer peripheral grooves of the flanking thumb wheel portions are formed during this blanking process. Also, if desired, the spiral groove providing the well-known "starts" required for an effective spark wheel can also be incorporated on the blanked unit during this manufacturing process on the automatic screw machine.

The final manufacturing step required to form the desired abrasive peripheral surface forming the spark wheel portion comprises rolling the blanked unit between two cooperative dies forming the desired abrasive peripheral surface. The roll forming process is thoroughly disclosed in the copending Patent Application of Stephen P. Chernock bearing Ser. No. 431,062, filed Jan. 7, 1974 and now U.S. Pat. No. 3,910,751.

The invention accordingly comprises an article of manufacture possessing the features, properties and the relation of elements which will be exemplified in the article hereinafter described, and the scope of the invention will be indicated in the claims.

THE DRAWINGS

For a fuller understanding of the nature and the objects of the invention, reference should be had to the following detailed description taken in connection with the accompanying drawings, in which:

FIG. 1 is a front elevation view of a spark and thumb wheel unit of this invention mounted in position in a lighter.

FIG. 2 is an exploded front view of a prior art thumb wheel and spark wheel assembly;

FIG. 3 is a front elevation view of a blank for the spark and thumb wheel unit of this invention; and FIG. 4 is a perspective view of the roll-forming equipment employed in forming the spark wheel surface of the spark and thumb wheel unit of this invention.

DETAILED DESCRIPTION

In FIG. 1, a one-piece spark and thumb wheel unit 20 of this invention is shown mounted in position in a lighter housing 22. As shown therein, spark and thumb wheel unit 20 is supported in position above flint 24 by means of upstanding support column 25 and 26.

The one-piece spark and thumb wheel unit 20 comprises a substantially cylindrical shape incorporating a spark wheel portion 28 flanked on both sides by thumb wheel portions 30 and 31. Spark wheel portion 28 comprises a peripheral outer abrasive surface which will produce a spark when spark wheel portion 28 is frictionally rubbed against flint 24. Spark wheel portion 28 is centrally disposed on the spark and thumb wheel unit 20, and incorporates a first diameter. Thumb wheel portions 30 and 31 are positioned on both sides of spark wheel portion 28 and comprises a second diameter which is slightly greater than the diameter of spark wheel portion 28. Thumb wheel portions 30 and 31 form the terminating sides of spark and thumb wheel unit 20, and incorporate substantially flat sides 32 and 33.

Spark and thumb wheel unit 20 also comprises, in the preferred embodiment, mounting pins 34 and 35 extending along the central axis of rotation thereof. Mounting pin 34 comprises a first diameter and extends from side surface 32. Mounting pin 35 comprises a second diameter, which is larger than the diameter of mounting pin 34, and extends from side 33. Spark and thumb wheel unit 20 is securely held in position in lighter 22 by positioning mounting pin 34 in cooperating hole 37 of support column 35 and positioning mounting pin 35 in cooperating hole 38 of support column 26. Holes 37 and 38 of lighter case 22 incorporate varying diameters in order to accommodate the respective pins mounted therein. In this manner, the desired orientation of the peripheral abrasive surface of spark wheel portion 28 is assured, and can be achieved automatically without requiring manual supervision or manual assembly.

As would be obvious to one skilled in the art, in order for the abrasive surface of spark wheel portion 28 to produce a spark when rotated against flint 24, directed in the proper direction toward the flammable gas, the abrasive surface of the spark wheel must be positioned in the proper direction in order to assure the effective operation of the lighter. By incorporating the optional dual diameter mounting feature of the present invention, the desired orientation of the spark wheel surface can be achieved quickly and automatically without necessitating manual controls.

The one-piece spark and thumb wheel unit of this invention provides unique advantages and substantial reductions in production costs than has heretofore been necessary with prior art spark and thumb wheel assemblies. In order to more fully understand the prior art assembly construction, reference should be had to FIG. 2, in which a typical prior art spark wheel and thumb wheel assembly is shown. The prior art assemblies all comprise three separate and distinct parts, a spark wheel 40, and two thumb wheel discs 41 and 42. Spark wheel 40 comprises an outer peripheral abrasive surface 43, and a central hole or cavity 44. Thumb wheel discs 41 and 42 both comprise an outer peripheral grooved surface 45, identically sized mounting pins 46, and identically sized spark wheel mounting ledges or bushings 47.

Prior art spark wheels 40 are generally manufactured by chiseling the outer peripheral surface with a chiseling tool in order to produce the abrasive surface 43. Since this operation is generally performed on an automatic screw machine, central hole or cavity 44 is incorporated in order to provide the proper support and rotation of the spark wheel blank during this chiseling operation. Consequently, in order to provide spark wheel 40 with a seperate thumb grippable surface aside from the spark wheel itself which, when rotated, will also cause spark wheel 40 to rotate against the flint when installed in a lighter system, thumb wheel discs 41 and 42 are employed. The identically sized and shaped discs 41 and 42 are mounted on either side of spark wheel 40 by inserting bushing 47 of the thumb wheel disc into cavity 44 of spark wheel 40. Bushings 47 are sized in order to provide a "press fit" of bushing 47 within cavity 44. Then, the entire spark wheel and thumb wheel assembly is rotatably mounted in a lighter system using mounting pins 46.

One of the disadvantages found with this prior art spark wheel and thumb wheel assembly, is the fact that the frictional contact between bushing 47 of thumb wheel discs 41 and 42 with cavity 44 of spark 40 is not always maintained sufficiently strong enough to cause the abrasive surface 43 of spark wheel 40 to rotate against the flint. Once this frictional drive breaks down, thumb wheel discs 41 and 42 are completely ineffective in causing the spark wheel 40 to rotate properly.

A further disadvantage found with these prior art assemblies is that substantially identically sized and shaped thumb wheel discs are employed. As a result, the mounting pins are indistinguishable from each other and the spark wheel must be visually checked before insertion into the lighter system in order to be certain that abrasive surface 43 of spark wheel 40 is properly oriented. This results in expensive labor costs and substantially increases the assembly operation.

In some prior art lighter systems, the cost of assembly is slightly reduced by not using thumb wheel discs. Instead, merely a mounting pin is inserted through central cavity 44 with the pin being used to mount the spark wheel in the lighter system. Even though this method eliminates cost of employing and mounting rotation inducing thumb wheel discs, it has the disadvantage of requiring the user of the lighter to rotate the spark wheel by gripping the spark wheel itself. Obviously, this has the undesirable result of depositing flint scrapings and carbon on the thumb of the user.

By employing the one-piece, substantially cylindrical spark and thumb wheel unit of this invention, the advantages of having a separate and distinct surface for rotating the spark wheel, other than the spark wheel itself, is provided while the cost of the unit is maintained substantially identical to prior art spark wheels alone. Furthermore, the one-piece spark and thumb wheel unit of this invention, in its preferred embodiment, incorporates means for automatically assembling the spark and thumb wheel unit in the lighter system without the need for manual or visual control.

The one-piece spark and thumb wheel unit of this invention is manufactured in two basic operations. The first operation, preferably performed on an automatic screw machine, produces a substantially cylindrical one-piece spark and thumb wheel blank 50, shown in FIG. 3. Blank 50 incorporates mounting pins 34 and 35 located along the central axis of rotation thereof, thumb wheel portions 30 and 31, with the grooved surface formed therein, and a blank spark wheel portion 52. As is well-known in the art, a spiral groove must be incorporated on the outer peripheral surface of the spark wheel portion in order to provide the necessary "starts" for the proper operation of the spark wheel surface. If desired, this spiral groove can be cut into surface 52 of blank 50 during the automatic screw machine operation. Alternatively, as will be more fully described below, the spiral groove or "starts" can be imparted to surface 52 during the roll-forming step.

The second and last operation for manufacturing the one-piece spark and thumb wheel unit 20 of this invention is a roll-forming step shown in FIG. 4. During this operation, the thumb and spark wheel blank 50 is rolled between two cooperating dies 54 and 56. Discs 54 and 56 comprise cutting faces which are sized to fit between thumb wheel portions 30 and 31. If desired, dies 54 and 56 can incorporate a dual faced cutting surface 57 and 58. Cutting surface 57 comprises pitched forming teeth which will produce the desired spiral groove on blank surface 52, while the cutting teeth on surface 58 will produce the desired abrasive surface 28 shown in FIG. 1. For a more detailed description and explanation of the roll-forming process, reference should be had to copending application of Stephen P. Chernock, bearing Ser. No. 431,062, filed on Jan. 7, 1974 now U.S. Pat. No. 3,910,751, and the pertinent information contained therein is incorporated herein by reference.

By employing this manufacturing process the one-piece spark and thumb wheel unit of this invention can be rapidly and efficiently manufactured completely automatically ready for automatic assembly in a lighter system. Consequently, as would be obvious to one skilled in the art, all of the inherent problems and difficulties encountered with prior art spark wheel and thumb wheel assemblies are completely eliminated and the production and labor costs inherent in the prior art assemblies are substantially reduced and in some cases completely eliminated with the unique one-piece spark and thumb wheel unit of this invention.

It will thus be seen that the objects set forth above, among those made apparent from the preceding description, are efficiently attained and since certain changes may be made in the above article without departing from the scope of the invention, it is intended that all matter contained in the above description or shown in the accompanying drawing shall be interpreted as illustrative and not in a limiting sense.

It is also to be understood that the following claims are to cover all of the generic and specific features of the invention herein described, and all statements of the scope of the invention which, as a matter of language, might be said to fall therebetween.

Having described my invention, what I claim as new and desire to secure by Letters Patent is:

1. A spark and thumb wheel unit comprising a solid, substantially cylindrical, one-piece single stock, homogeneous member incorporating A. a spark-producing portion comprising:
  a. a first diameter, and
  b. an abrasive peripheral surface, B. a rotation-controlling portion comprising:
  a. a second diameter greater than said first diameter, and
  b. positioned for easy, controlled rotation of said spark producing portion, and C. trunnion means integrally formed on the substantially flat sides of said spark and thumb wheel, for cooperation with trunnion supports to securely and rotatably hold said spark and thumb wheel unit in a lighter system without necessitating a through-hole member extending through the entire spark and thumb wheel.

2. The spark and thumb wheel unit defined in claim 1, wherein said rotation-controlling portion comprises a grooved peripheral surface, providing a readily accessible easily rotatable surface for assuring rotation of the entire spark and thumb wheel unit by movement of the operator's thumb.

3. A spark and thumb wheel unit defined in claim 1, wherein said trunnion means comprises two pins extending from each side of said substantially cylindrical one-piece member along its central axis of rotation.

4. The spark and thumb wheel unit defined in claim 3, wherein one of said mounting pins comprises a diameter greater than the diameter of the other of said mounting pins.

5. A spark and thumb wheel unit comprising a solid, substantially cylindrical, one-piece member incorporating A. a spark-producing portion comprising:
  a. a first diameter, and
  b. an abrasive peripheral surface, B. a rotation-controlling portion comprising:
  a. a second diameter greater than said first diameter, and
  b. positioned for easy, controlled rotation of said spark producing portion, and C. means on opposite sides of the wheel for rotatably mounting said spark and thumb wheel units, including orientation defining means of different diameters integrally formed on opposite sides of said spark wheel for assuring the mounting position of said spark and thumb wheel in said lighter system.

* * * * *